US005649339A

United States Patent [19]

Reed

[11] Patent Number: 5,649,339

[45] Date of Patent: Jul. 22, 1997

[54] DOOR CLOSING DEVICE

[76] Inventor: Clay R. Reed, 2232 Gable Ct., Rosamond, Calif. 93560

[21] Appl. No.: 688,693

[22] Filed: Jul. 29, 1996

[51] Int. Cl.[6] ..... E05F 1/08

[52] U.S. Cl. ..... 16/72; 16/50

[58] Field of Search ..... 16/71, 75, 72, 16/50, 285

[56] References Cited

U.S. PATENT DOCUMENTS

| | | | |
|---|---|---|---|
| 724,039 | 3/1903 | Peterkin | 16/285 |
| 1,215,498 | 2/1917 | Dietz | 16/72 |
| 2,660,750 | 12/1953 | Wallen | 16/50 |
| 3,098,258 | 7/1963 | Ruiz | 16/50 |
| 3,157,906 | 11/1964 | Wolf | 16/50 |
| 4,351,085 | 9/1982 | Suska | 16/273 |
| 4,413,373 | 11/1983 | Sasaki | 16/54 |

*Primary Examiner*—Chuck Y. Mah

[57] ABSTRACT

An assembly is arranged to include a tensioning means mounted within a housing structure. The assembly attaches to the head of an installed door hinge pin in order to store energy into such attachment to cause the door to close after having been opened then released, by reason of extended ends of the tensioning means interacting against the opposing door and wall.

1 Claim, 1 Drawing Sheet

DOOR CLOSING DEVICE

BACKGROUND OF THE INVENTION

1. Field of the Invention

The field of invention relates to hinges, and more particularly pertains to a hinge attachment to cause a door to close after having been opened then released.

2. Description of the Prior Art

Hinge closing structure employing tension is indicated in the Prior Art in U.S. Pat. No. 4,351,085 to Suska, wherein the mechanism is wholly enclosed within the hinge itself. Installation requires the removal of the existing hinge then installing the self closing hinge. The installation is therefore considered to be permanent.

Another door closing device utilizes a spring and pin assembly designed to replace an existing door hinge pin. The device requires tools to install or remove. The efficiency of the device is severely limited as the points of closing force extend only to the proximal portions of the hinge leaves. Also, the diameter of the pin is not necessarily suitable for the hinge to which it is applied.

Other door closing devices employing tension or compression mechanisms also require the use of tools to install or remove. These devices are generally considered permanent attachments.

The instant invention is new and apart from the Prior Art, as it provides for a means to quickly remove or reinstall a door closing device without the need for hand tools. Also, the instant invention provides the similar closing function of the Prior Art without having to replace the entire hinge or hinge pin or in any other way effect a permanent modification to a door or door hinge, and in this respect the present invention substantially fulfills this need.

SUMMARY OF THE INVENTION

In view of the foregoing disadvantages inherent in the known types of self closing hinge apparatus now present in the prior art, the present invention provides for an attachment to quickly and easily convert an already installed door hinge into a self closing mechanism, or also, to revert the hinge to normalcy.

To attain this, the present invention provides for an attachment to include a helical torsion spring for tensioning means, centrally fixed into a housing structure which attaches to an existing hinge pin head in order to store energy for the purpose of closing a door after the door has been opened then released. The closing energy or force being applied to the opposing door and wall by reason of the spring ends extending radially outward and in contact with said door and wall, and pads mounted to the spring ends to prevent marring and assist in the installation of the device.

OBJECTS AND ADVANTAGES

It is an object of the present invention to provide for a door closing device which makes no permanent modification to a door or door hinge nor replaces any parts thereof.

Another object of the present invention is to provide for a door closing device which is readily removed or reinstalled without the need for hand tools.

Another object of the present invention is to provide for a door closing device which is easily and efficiently manufactured and marketed.

A further object of the present invention is to provide for a door closing device which is susceptible of low cost of manufacture and therefore a low retail price of sale.

DESCRIPTION OF THE PREFERRED EMBODIMENT

Figure 1:
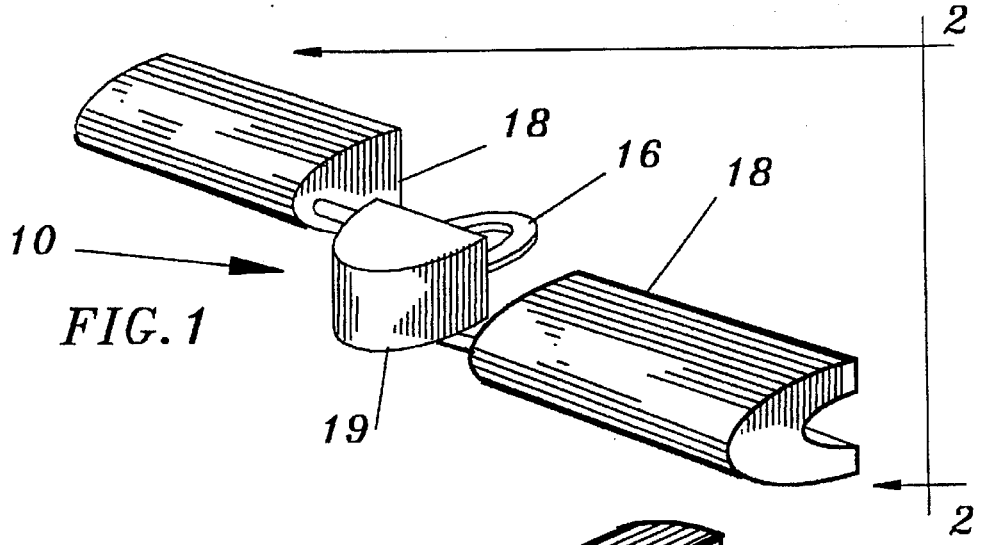
FIG. 1 is a frontal perspective view of the entire apparatus.
Figure 2:
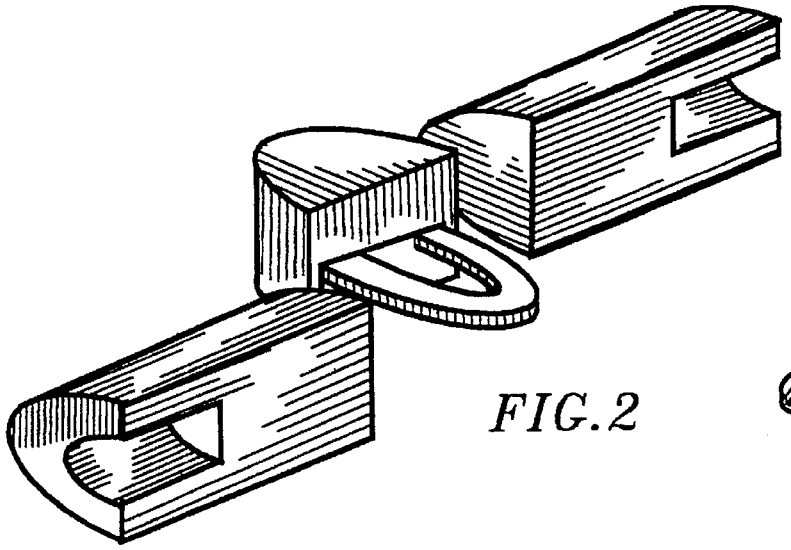
FIG. 2 is a rear perspective view of the entire apparatus taken along the lines 2—2 of FIG. 1.
Figure 3:
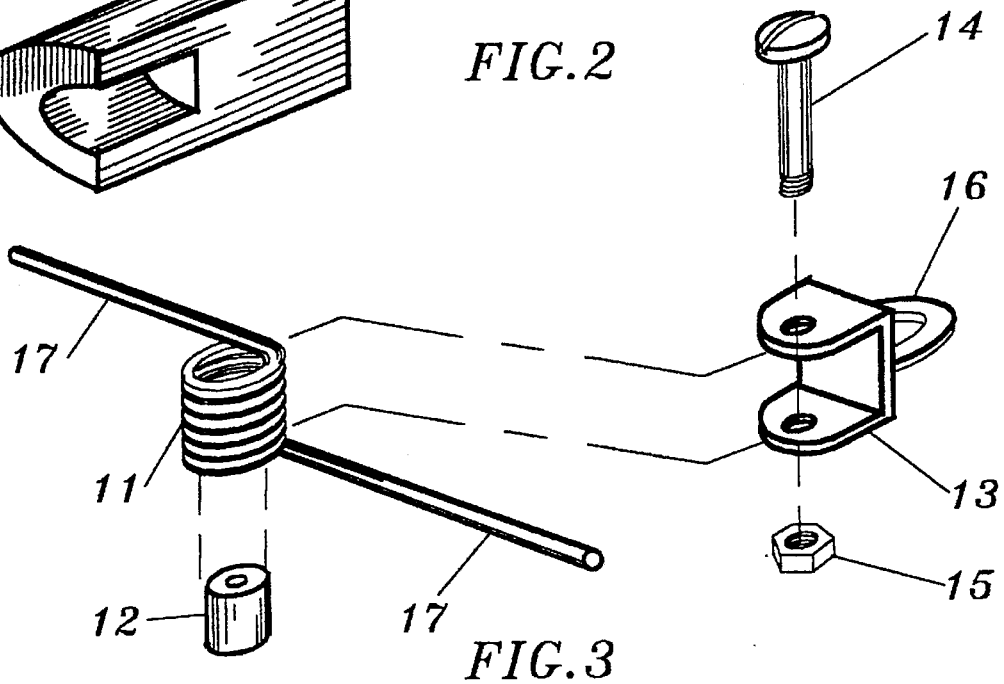
FIG. 3 is an exploded view of the apparatus minus the dust cap and end pads.

With reference now to the drawings, a new and useful door closing device generally designated by the numeral 10 will be described.

More specifically, the door closing apparatus 10 of the instant invention includes a spring 11 affixed around a spindle 12 centered into a housing 13. Bolt 14 is extended coextensive through the spindle and secured at the opposite end of the housing with a nut 15.

Projecting from the posterior portion of the housing is an anchoring loop 16 which attaches around a hinge pin head.

To prevent marring to the door and wall from the extended spring ends 17 and for assisting in stressing the spring open during installation, end pads 18 are provided which mount to the spring ends. Also, a cosmetic dust cap 19 is provided.

The device attaches to the hinge pin head of an already installed door hinge. The installed device is held in place by reason of the inherent tension of the spring causes the anchoring loop to be held against the hinge pin while the hinge pin head prevents the device from slipping off. The extended spring ends along with the end pads provide the necessary points of contact with the adjoining door and wall to utilize the stored energy of the spring to cause the door to close. As the door is opened, the tension in the spring increases thereby storing the force to close the door once the door is released.

With respect to the foregoing description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated are intended to be encompassed by the present invention.

What is claimed as being new and desired to be protected by LETTERS PATENT of the United States is as follows:

1. A door hinge attachment (10), which urges a door closed, comprising, a freely rotating helical torsion spring (11) fitted around a spindle (12) centrally secured into a housing structure (13), wherein said housing structure includes an anchoring loop (16) suitable to be fitted onto a hinge pin head and said anchoring loop not requiring that the hinge pin be withdrawn or reinserted in order for said attachment to be installed or removed, and said torsion spring including extended spring ends (17) to provide points of closing force against an opposing door and wall whereat the attachment is installed onto a hinge pin so as to cause the spring to wind as the door is opened thereby storing energy to cause the door to close after the door is released, and said extended spring ends including end pads (18) to protect against marring from the spring ends interacting against the door and wall.

* * * * *